US007458207B2

(12) United States Patent
Ehlers

(10) Patent No.: US 7,458,207 B2
(45) Date of Patent: Dec. 2, 2008

(54) DIESEL VEHICLE EXHAUST AFTERTREATMENT APPARATUS AND METHOD

(75) Inventor: Mark S. Ehlers, Fort Wayne, IN (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 375 days.

(21) Appl. No.: 11/246,351

(22) Filed: Oct. 7, 2005

(65) Prior Publication Data

US 2007/0079606 A1 Apr. 12, 2007

(51) Int. Cl.
*F01N 3/00* (2006.01)
*F01N 3/02* (2006.01)

(52) U.S. Cl. ..... 60/297; 60/287; 60/288; 60/311

(58) Field of Classification Search ..... 60/287, 60/288, 297, 311
See application file for complete search history.

(56) References Cited

U.S. PATENT DOCUMENTS 4,558,565 A * 12/1985 Kojima et al. ..... 60/286
5,121,601 A * 6/1992 Kammel ..... 60/275
5,282,002 A * 1/1994 Jacobs et al. ..... 399/119
5,956,944 A * 9/1999 Dementhon et al. ..... 60/274
6,233,926 B1 * 5/2001 Bailey et al. ..... 60/295

* cited by examiner

*Primary Examiner*—Thomas Denion
*Assistant Examiner*—Loren Edwards
(74) *Attorney, Agent, or Firm*—Jeffrey P. Calfa; Mark C. Bach; Gerald W. Askew

(57) ABSTRACT

The aftertreatment apparatus and method of the invention concentrate diesel exhaust under low engine load conditions in a motor vehicle, such as idling, before filtering the diesel exhaust. The apparatus has a housing which is in fluid communication with a filter and other components of the diesel exhaust system. The apparatus has an exhaust concentrator to concentrate the low load diesel exhaust. The concentrated exhaust is directed a limited part of the filter and/or the catalytic device, such as the center. The exhaust concentrator is at least partially disposed within the housing.

9 Claims, 4 Drawing Sheets

DIESEL VEHICLE EXHAUST AFTERTREATMENT APPARATUS AND METHOD

BACKGROUND OF THE INVENTION

1. Field of the Invention

The present invention relates to an aftertreatment apparatus and method for treating diesel exhaust in a motor vehicle.

2. Description of the Prior Art

Diesel engines are efficient, durable and economical. Diesel exhaust; however, can harm both the environment and people. To reduce this harm governments, such as the United States and the European Union, have proposed stricter diesel exhaust emission regulations. These environmental regulations require diesel engines to meet the same pollution emission standards as gasoline engines.

One part of diesel exhaust includes diesel particulate material. Diesel particulate material is mainly carbon particles or soot. One way to remove soot from diesel exhaust is with diesel traps. The most widely used diesel trap is a diesel particulate filter which nearly completely filters the soot without hindering exhaust flow. As a layer of soot collects on the surfaces of the inlet channels of the filter, the lower permeability of the soot layer causes a pressure drop in the filter and a gradual rise in the back pressure of the filter against the engine. This phenomenon causes the engine to work harder, thus decreasing engine operating efficiency. Eventually, the pressure drop in the filter and decreased engine efficiency becomes unacceptable, and the filter must either be replaced or the accumulated diesel soot must be cleaned out.

The filter is cleaned of accumulated diesel soot by burning-off or oxidation of the diesel soot to carbon dioxide which is known as regeneration. Regeneration of an existing filter is superior to filter replacement, because no interruption for service is necessary.

The regeneration process is either passive or active. Passive regeneration occurs when the filter becomes so filled with carbon particles that heat increases within the exhaust system due to excessive back pressure. The increased heat raises the temperature of the carbon to a point where the carbon ignites. This design, however, often results in thermal shock or melt down of the filter, high fuel penalty and poor filtering action.

Active regeneration uses heat generated by an outside source under controlled conditions to initiate combustion of the diesel soot. Soot slowly burns for a brief period. During this burn, the temperature in the filter rises from about 400°-600° C. to about 800°-1000° C. The highest temperatures occur near the exit end of the filter due to the cumulative effects of the wave of soot combustion from the entrance face to the exit face of the filter as the exhaust flow carries the combustion heat down the filter. Electrical power, fuel burners and microwave energy are all used as outside heat sources.

Under certain circumstances, a so-called "uncontrolled regeneration" occurs when the onset of combustion coincides with, or is immediately followed by, high oxygen content and low flow rates in the exhaust gas (such as engine idling conditions or low loads). During an uncontrolled regeneration, the combustion of the soot may produce temperature spikes within the filter which can thermally shock and crack, or even melt, the filter.

In addition to capturing carbon soot, the filter also traps ash particles, such as metal oxides, that are carried by the exhaust gas. These particles are not combustible and, therefore, are not removed during regeneration. If temperatures during uncontrolled regenerations are sufficiently high, however, the ash may eventually sinter to the filter or react with the filter, thus resulting in partial melting.

Furthermore under light loads and idling conditions, the stream of exhaust particles is too dilute to efficiently burn the soot to regenerate the filter. Under such light loads, the stream of exhaust particles is at a lower pressure and temperature than the exhaust stream at medium to full loads. This can inhibit the regeneration of the filter or lead to uncontrolled regeneration of the filter.

Therefore, it would be advantageous to increase the efficiency of the regeneration of the filter while inhibiting uncontrolled regenerations. It would be further advantageous to increase the efficiency of the diesel aftertreatment without using costly parts or requiring bulky additional equipment.

SUMMARY OF THE INVENTION

According to the invention an exhaust aftertreatment apparatus filters diesel exhaust from an engine in a motor vehicle. The apparatus has a housing in fluid communication with an entrance conduit leading from the engine and an exit conduit leading from the housing. A filter is disposed within the housing downstream from the entrance conduit.

An exhaust concentrator is at least partially disposed within the housing. The exhaust concentrator concentrates the diesel exhaust produced under low load conditions and directs the concentrated diesel exhaust to a limited area of the filter, such as the filter's center. The filter now filters the concentrated diesel exhaust. The filtered exhaust flows out of the filter and the exit conduit.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
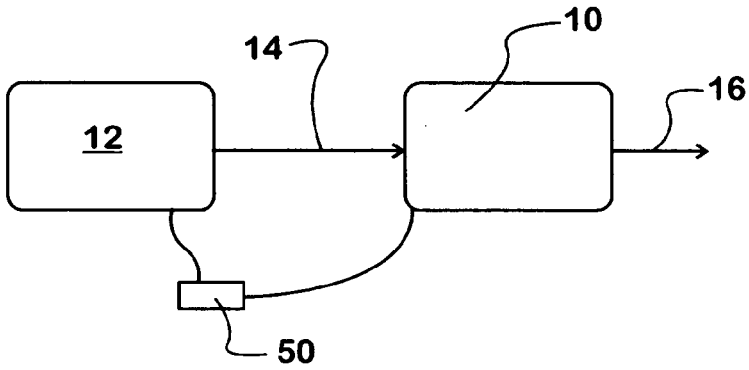
FIG. 1 is a schematic view of an engine and aftertreatment apparatus of the invention.

Turning to the Figures where like reference numerals refer to like structures, the present invention relates to an aftertreatment apparatus 10 for treating diesel exhaust gases from a diesel engine 12 in a motor vehicle, especially under light loads. In this disclosure, the term "light load" can refer to the diesel exhaust emissions produced by an engine under light or idling conditions.

The engine 12 is in fluid communication with the aftertreatment apparatus 10 through an entrance conduit 14. Treated exhaust flows from the aftertreatment apparatus 10 through an exit conduit 16.

The aftertreatment apparatus 10 includes a catalytic device 18 in fluid communication with a diesel particulate filter 20. The catalytic device 18 and the filter 20 can both be located in one housing 22 (FIG. 2) or located in separate housings 23, 24 (FIG. 3) in fluid communication with each other. When located in the same housing 22, the catalytic device 18 and the filter 20 can abut one another.

The housing 22 is in fluid communication with the entrance conduit 14, preferably with the housing end 26 of the entrance conduit 14 connecting with the housing 22.

An exhaust concentrator 30 is at least partially disposed within a housing 22 (FIG. 2) 24 (FIG. 3) and can attach to the interior weldments of the motor vehicle. The exhaust concentrator 30 concentrates the diesel particulate material 32 under light loads and forces the diesel particulate material 32 to flow through a limited portion of the filter 20, such as the filter center 21. Under medium or heavy loads, the exhaust concentrator 30 allows the unconcentrated diesel particulate material 32 access to the entire diameter of the filter 20 for filtering through the entire filter.

The exhaust concentrator 30 can include a concentrator tube 34 that slidingly engages the housing end 26 of the entrance conduit 14. The concentrator tube 34 can be cylindrical or flared at one end. The concentrator tube 34 slides from a open position during medium to heavy loads to a closed position during light loads. The concentrator tube 34 can slide axially or radially to abut a filter face 46 (FIG. 3) or a catalyst face 48 (FIG. 2).

Figure 2:
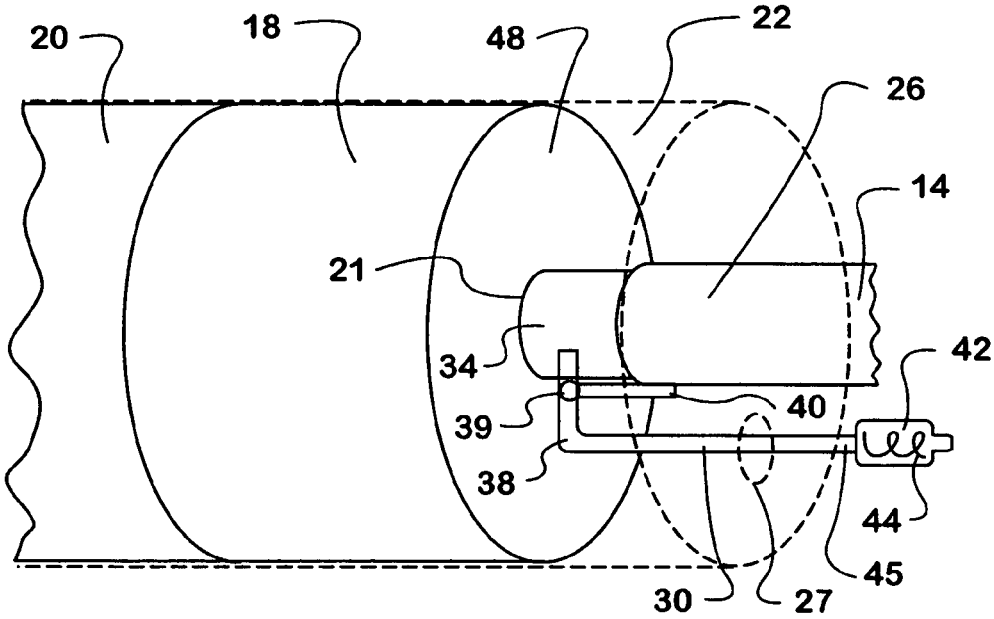
FIG. 2 is a partial perspective view of a first embodiment of an aftertreatment apparatus of the invention under light exhaust loads.
Figure 4:
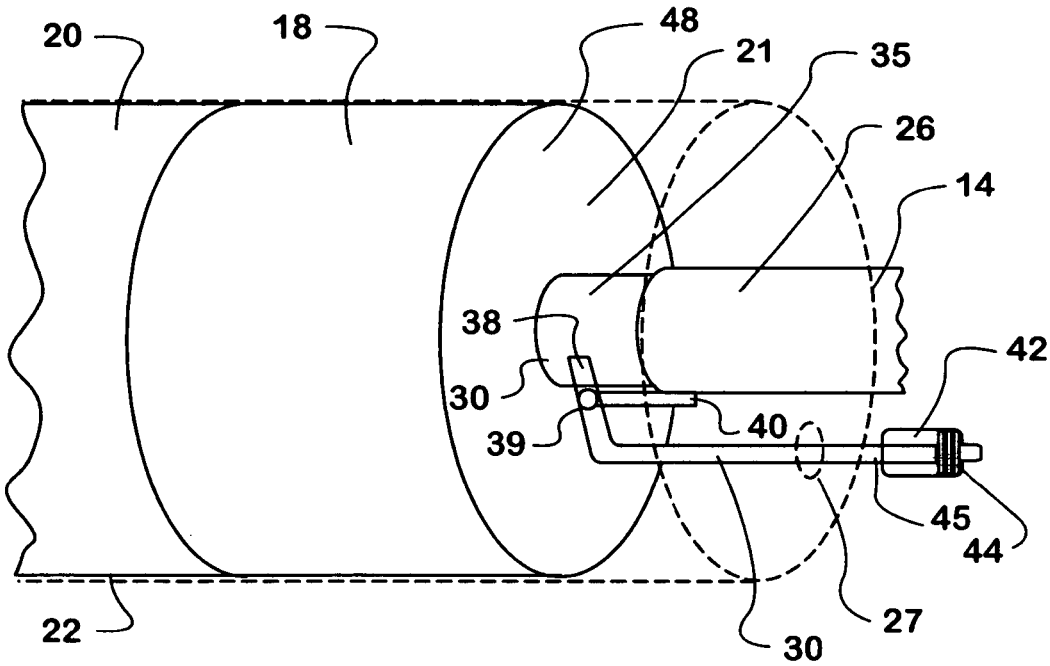
FIG. 4 is a partial perspective view of the first embodiment of an aftertreatment apparatus of the invention under heavy exhaust loads.
Figure 5:
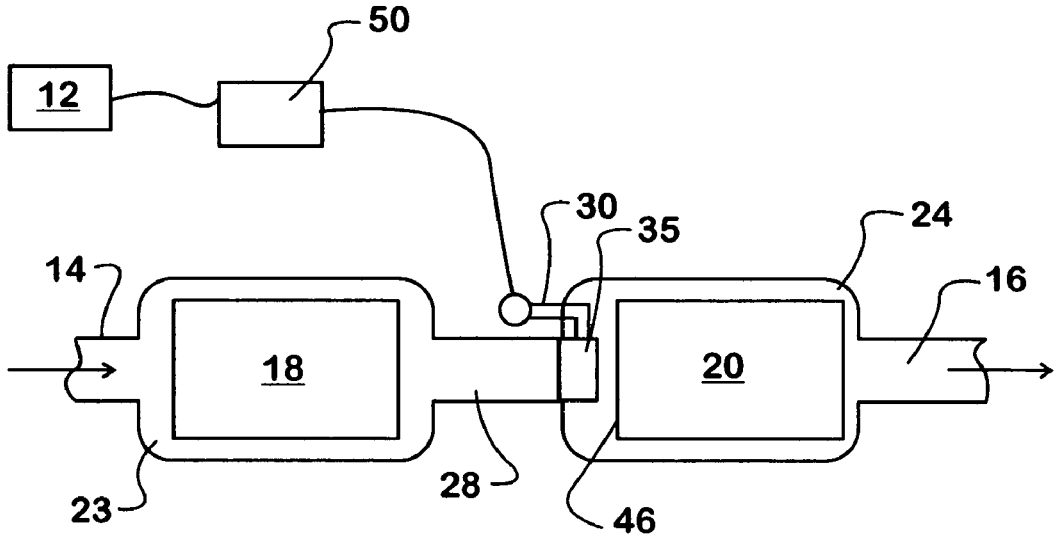
FIG. 5 a side view of a second embodiment of an aftertreatment apparatus of the invention under heavy exhaust loads.

As shown in FIGS. 2 and 4, the exhaust concentrator 30 has an actuator 36 with a pivot arm 38 pivotally attached to a base 40 at a pivot 39 and a modulator 42. The pivot arm 38 can extend from the base 40 through an opening 27 within the housing 22 to the modulator 42 outside the housing 22. The base 40 can attach to the housing end 26 of the entrance conduit 14. During light loads, the modulator 42 pivots the pivot arm 38 toward the catalyst face 48 which slides the concentrator tube 34 toward the catalyst face 48 until abutting the catalyst face 48. Under heavier loads, the modulator 42 pivots the pivot arm 38 away from the catalyst face 48 which slides the concentrator tube 34 away from the catalyst face 46.

The modulator 42 can include anything that moves the pivot arm, such as a spring 44. The spring 44 expands under low loads and pushes a spring arm 45 extending though the housing opening 27 and attaching to the pivot arm 38. The spring arm 45 and the pivot arm 38 can be one piece or separate pieces. Under heavier loads, a turbo boost from the engine retracts the spring 44, which pulls the spring arm 45 and pivot arm 38 away from the catalyst face 48 and moves the concentrator tube 34 away from the catalyst face 48. The exhaust stream now freely flows across the entire catalyst face 48 and enters the catalytic device 18.

Figure 3:
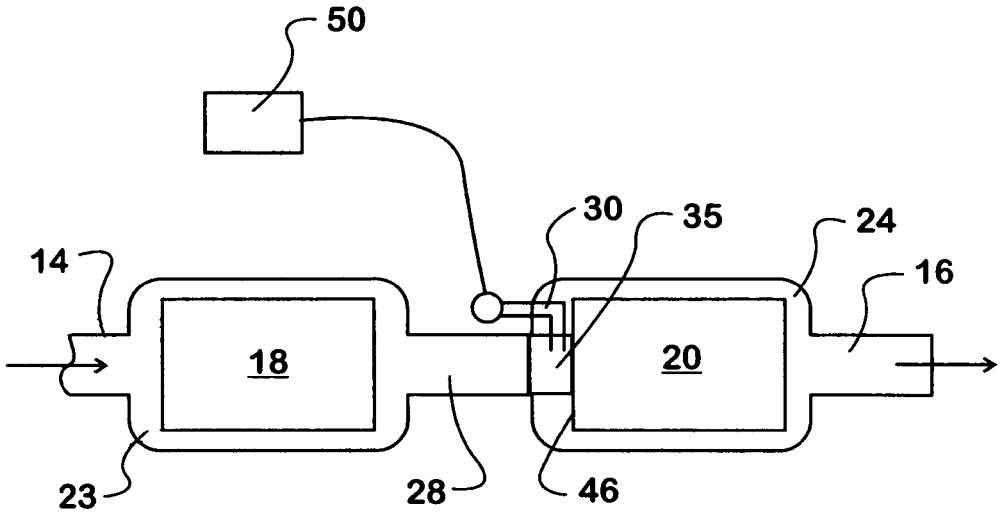
FIG. 3 is a side view of a second embodiment of an aftertreatment apparatus of the invention under light exhaust loads.

FIG. 3 shows the exhaust concentrator 30 at least partially disposed within a passageway 28 between housings 23, 24. The modulator 43 is in communication with a controller 50 monitoring the engine load and/or conditions within the exhaust system. Under a light load, the controller 50 signals the modulator 43 to release spring 52. The concentrator tube 35 rotates axially and fully extends to abut the filter face 46. When the controller 50 detects a heavier load, the controller 50 signals the modulator 43 to retract the spring 52 and the concentrator tube 35 rotates axially away from the filter face 46.

Figure 6:
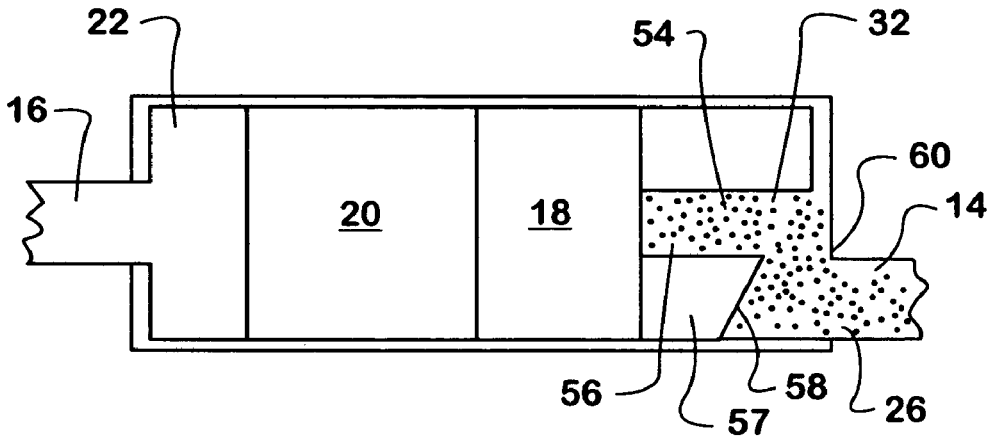
FIG. 6 is a side view of a third embodiment of an aftertreatment apparatus of the invention under light exhaust loads.
Figure 7:
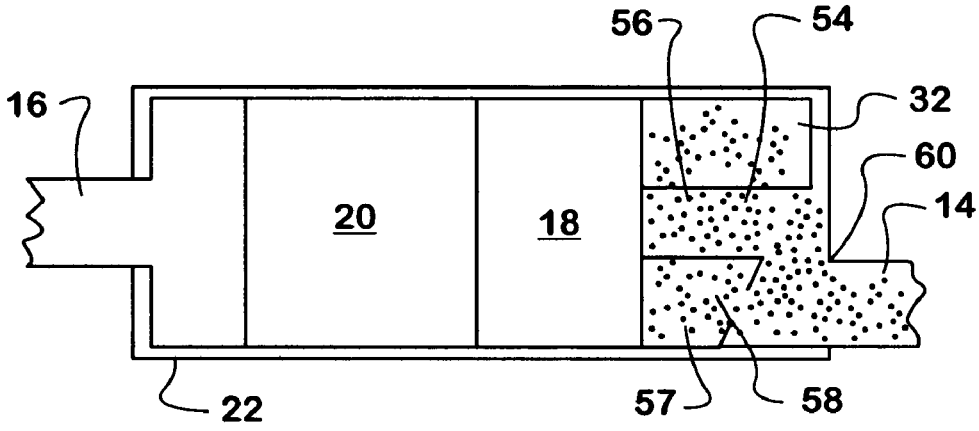
FIG. 7 is a side view of a third embodiment of an aftertreatment apparatus of the invention under heavy exhaust loads.

Turning to the embodiment shown in FIGS. 6 and 7, the exhaust concentrator 54 is in fluid communication and connects with the housing end 26 of the entrance conduit 14 at the proximal end 60 of the housing 22. The exhaust concentrator 54 has a concentrator tube 56 and an adjacent exhaust branch 57 with a valve 58 which opens and closes the exhaust branch 57. Under light loads, the valve 58 is closed (FIG. 6) to concentrate the exhaust within the concentrator tube 56 and direct the flow to the center of the catalytic device 20. Under heavier loads, the valve 58 opens to allow the exhaust to flow into the exhaust branch 57 which allows access to all of the catalytic device 18 (FIG. 7).

Figure 8:
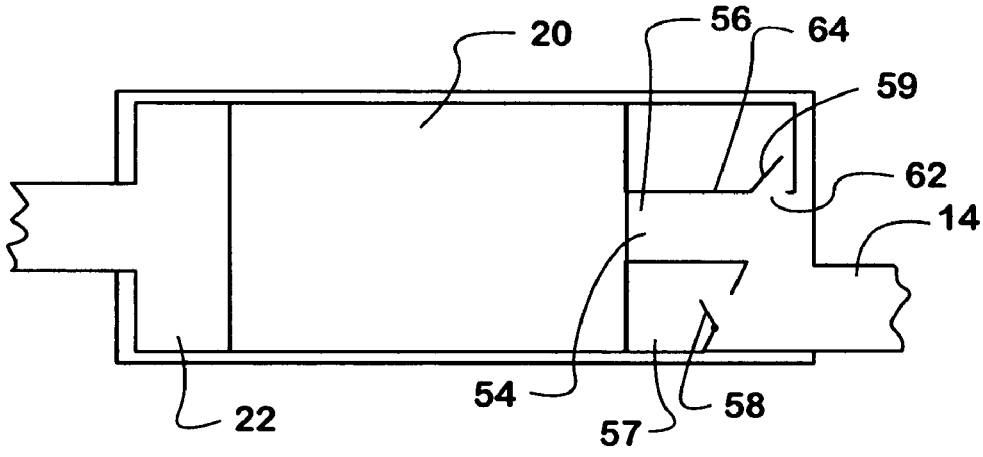
FIG. 8 is a side view of another embodiment of an aftertreatment apparatus-of the invention under heavy exhaust loads.

The concentrator tube 56 can have a wall 64 with an aperture 62 (FIG. 8). The aperture 62 can have an aperture valve 59 to open and close the aperture. The aperture valve 59 further opens the concentrator tube 56 during higher load conditions.

Valves can include butterfly valves, throttle valves, servo spring valves connected to a throttle plate, and the like. The valve can open and close by responding to the pressure in the exhaust branch 57, such as by opening during a turbo boost. The valve can be in communication with the controller 50 to receive signals from the controller 50 to open and close.

The controller 50 can be in communication with sensors, the engine, the valves or the modulator. Sensors, for example, can measure temperature, pressure, and the like within the exhaust system or the engine, and send the measurement to the controller 50. The controller 50 can be programmed to respond to set conditions to signal the exhaust concentrator to concentrate the exhaust, for example by opening and closing the valves or releasing and retracting of the springs.

A heat source, such as a fuel, electrical or microwave heating source, can be located at or near the entrance of the aftertreatment apparatus 10 to enhance regeneration, if desired.

The aftertreatment apparatus of the invention uses an exhaust concentrator to concentrate a dilute stream of the diesel particulate material produced by the engine under low load conditions into a concentrated stream of diesel particulate material. Instead of the dilute stream of particulate material entering the filter in a diffuse manner, the exhaust concentrator concentrates the diesel particulate material and focuses the material to a smaller location to enter the filter and/or catalytic device. This concentration increases the pressure within the exhaust conduit and the temperature to produce optimum conditions for filter regeneration under light exhaust loads while preventing uncontrolled regeneration.

The aftertreatment apparatus of the invention increases the efficiency of the regeneration of the filter while inhibiting uncontrolled regenerations, Yet, the aftertreatment apparatus neither uses costly parts nor requires bulky additional equipment.

While the Figures show the filter downstream from the catalytic device, the filter could be located upstream from the catalytic device. While the invention is shown in only one of its forms, it is not thus limited but is susceptible to various changes and modifications without departing from the spirit and scope of the invention.

What is claimed is:

1. A diesel exhaust aftertreatment apparatus for a diesel exhaust system in a motor vehicle, comprising:

an entrance conduit;

an engine in fluid communication with the entrance conduit;

an exit conduit;

a housing in fluid communication with the entrance conduit and the exit conduit;

a filter disposed within the housing, and having a filter face;

an exhaust concentrator being at least partially disposed within the housing and having a concentrator tube, and an actuator having a modulator, a pivot arm connecting to the concentrator tube and the modulator, and a base pivotally attaching to the pivot arm;

wherein the modulator comprises a spring arm connecting to the pivot arm, and a spring attaching to the spring arm; and wherein the concentrator tube slides from an open position to a closed position abutting the filter face during low engine loads.

2. The diesel exhaust aftertreatment apparatus of claim 1, further comprising:

a controller in communication with the modulator to move the pivot arm.

3. A diesel exhaust aftertreatment apparatus for a diesel exhaust system in a motor vehicle, comprising:

an entrance conduit;

an engine in fluid communication with the entrance conduit;

an exit conduit;

a housing in fluid communication with the entrance conduit and the exit conduit;

a filter disposed within the housing, and having a filter face;

an exhaust concentrator being at least partially disposed within the housing and having a concentrator tube, and an actuator having modulator pivot arm connecting to the concentrator tube and the modulator, and a base pivotally attaching to the pivot arm;

wherein the modulator comprises a spring arm, connecting to the pivot arm, and a spring attaching to the spring arm;

a catalytic device in fluid communication with the filter and entrance conduit, and having a catalyst face; and wherein the concentrator tube slides from an open position to a closed position abutting the catalyst face during low engine loads.

4. A method of treating diesel exhaust from an engine in a motor vehicle, the method comprising the steps of:

exhausting diesel exhaust from the engine through an entrance conduit in fluid communication with the engine;

allowing the diesel exhaust to flow from the entrance conduit into a housing having an exhaust concentrator being at least partially disposed within the housing and having a concentrator tube;

concentrating the diesel exhaust with the exhaust concentrator under low load conditions;

directing the concentrated diesel exhaust through the concentrator tube to a limited portion of a filter located downstream from the concentrator and in fluid communication with the entrance conduit;

filtering the concentrated diesel exhaust within the filter;

allowing the filtered diesel exhaust to flow from an exit conduit in fluid communication with the filter;

moving the concentrator tube to abut a filter face of the filter with the modulator before concentrating the diesel exhaust; and wherein the exhaust concentrator comprises an actuator having a pivot arm connecting to the concentrator tube, a base pivotally attaching to the pivot arm, and a modulator connecting to the pivot arm.

5. A method of treating diesel exhaust from an engine in a motor vehicle of claim 4, wherein the modulator further comprises:

a spring arm connecting to the pivot arm; and a spring attaching to the spring arm.

6. A method of treating diesel exhaust from an engine in a motor vehicle of claim 4, further comprising the steps of:

measuring the load on the engine with a controller; and signaling the modulator from the controller to move the concentrator tube.

7. A method of treating diesel exhaust from an engine in a motor vehicle, the method comprising the steps of:

exhausting diesel exhaust from the engine through an entrance conduit in fluid communication with the engine;

allowing the diesel exhaust to flow from the entrance conduit into a housing having an exhaust concentrator being at least partially disposed within the housing and having a concentrator tube;

concentrating the diesel exhaust with the exhaust concentrator under low load conditions;

directing the concentrated diesel exhaust through the concentrator tube to a limited portion of a filter located downstream from the concentrator and in fluid communication with the entrance conduit;

filtering the concentrated diesel exhaust within the filter;

allowing the filtered diesel exhaust to flow from an exit conduit in fluid communication with the filter;

moving the concentrator tube to abut a catalyst face of a catalytic device with the modulator before concentrating the diesel exhaust; and wherein the exhaust concentrator comprises an actuator having a pivot arm connecting to the concentrator tube, a base pivotally attaching to the pivot arm, and a modulator connecting to the pivot arm.

8. A method of treating diesel exhaust from an engine in a motor vehicle of claim 7, wherein the modulator further comprises:

a spring arm connecting to the pivot arm; and a spring attaching to the spring arm.

9. A method of treating diesel exhaust from an engine in a motor vehicle of claim 8, further comprising the steps of:

measuring the load on the engine with a controller; and signaling the modulator from the controller to move the concentrator tube.

* * * * *